US006943670B2

(12) United States Patent
Liguori et al.

(10) Patent No.: US 6,943,670 B2
(45) Date of Patent: Sep. 13, 2005

(54) WRITING INSTRUMENT WITH DISPLAY MODULE

(75) Inventors: Thomas A. Liguori, Poway, CA (US); Thomas H. Lupfer, Poway, CA (US)

(73) Assignee: TLCD, Ltd., San Diego, CA (US)

( * ) Notice: Subject to any disclaimer, the term of this patent is extended or adjusted under 35 U.S.C. 154(b) by 36 days.

(21) Appl. No.: 10/279,236

(22) Filed: Oct. 24, 2002

(65) Prior Publication Data

US 2004/0080400 A1 Apr. 29, 2004

(51) Int. Cl.[7] ..... G08B 23/00

(52) U.S. Cl. ..... 340/321; 340/568.1; 340/686.1; 340/691.6; 340/691.1; 362/579; 362/559; 362/561

(58) Field of Search ..... 340/321, 815.4, 340/815.49, 815.53, 331, 568.1, 686.1, 689, 669, 670, 671, 691.6, 691.1, 815.04, 815.45; 362/559, 561, 579; 345/179, 126, 156; 178/18.01, 19.05, 19.04, 19.01

(56) References Cited

U.S. PATENT DOCUMENTS 4,466,742 A * 8/1984 Lemelson ..... 368/10
5,544,967 A * 8/1996 Yao ..... 401/195
5,563,996 A * 10/1996 Tchao ..... 715/221
5,593,390 A * 1/1997 Castellano et al. ..... 604/187
6,119,944 A * 9/2000 Mulla et al. ..... 235/472.03
6,130,666 A * 10/2000 Persidsky ..... 345/179
6,265,984 B1 * 7/2001 Molinaroli ..... 340/815.4
6,380,928 B1 * 4/2002 Todd ..... 345/169
6,567,120 B1 * 5/2003 Hamamura et al. .... 348/207.99
6,577,299 B1 * 6/2003 Schiller et al. ..... 345/179
6,657,618 B2 * 12/2003 Moore ..... 345/179
6,674,530 B2 * 1/2004 Berstis ..... 356/406
6,724,351 B1 * 4/2004 Boger ..... 345/3.2
2004/0113877 A1 * 6/2004 Abileah et al. ..... 345/92

* cited by examiner

*Primary Examiner*—Jeffery Hofsass
*Assistant Examiner*—Daniel Previl
(74) *Attorney, Agent, or Firm*—Pillsbury Winthrop Shaw Pittman LLP

(57) ABSTRACT

A writing instrument including an integrated display module. The display module is used to provide a presentation to a user or consumer. The presentation can be in the form of scrolling text, a still image, a flashing image, an image that fades in and out of view or a movie. The presentation can be an advertisement, for entertainment or informative in nature.

24 Claims, 6 Drawing Sheets

WRITING INSTRUMENT WITH DISPLAY MODULE

BACKGROUND

1. Field of the Invention

This invention generally relates to an apparatus for providing electronic advertising.

2. Related Art

It is known in the art generally that the presentation of customized materials and graphics to individuals is an effective way of increasing attention, interest and often sales. Such presentations in the form of advertisements, novelty items and souvenirs are often limited because there is no functional or dynamic element that is capable of enhancing the presentation in a way that provides a consumer with a memorable and useful apparatus. Known apparatuses such as bottle openers, lighters and ballpoint pens, configured such that the apparatus includes a presentation thereon, have certain disadvantages. For example, the presentations are often printed onto the apparatus in a conventional manner in which the presentation wears off and is no longer legible upon repeated use of the apparatus. Another disadvantage of the prior art is that after reading the presentation several times, the user of the apparatus becomes accustomed to the presentation and, effectively, no longer recognizes or observes the presentation, diminishing the effectiveness of the presentation. Furthermore, because such presentations are static, they do not consistently attract the user's attention. Additionally, the physical limitations on the space available to place a static advertisement on an apparatus does not allow for the prolific transmission of advertising as an ad specialty, information on a souvenir. Static advertisements can only be of limited predetermined physical dimensions and cannot be dynamically enhanced and modified to increase their effectiveness.

Therefore, there is a need for an apparatus that provides a long-lasting and attention-catching presentation. The power of this improved apparatus results in greater effectiveness of the presentation and, in some cases, higher response rates and/or interest levels by the user or consumer to the presentation and improved profitability by the developer, manufacturer and distributor of the apparatus The present invention fulfills this need by providing an apparatus implementing dynamic, attention-getting presentations that can be of expanded length because the presentation is digitally stored rather than merely a printed advertisement.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION

Figure 1A:
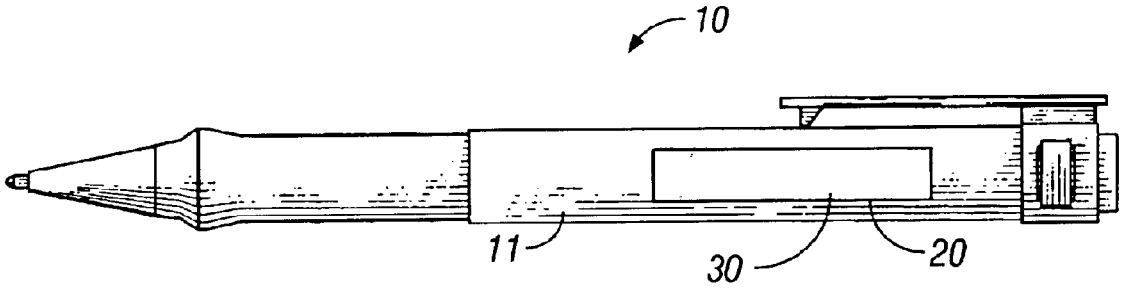
FIGS. 1A & 1B illustrate a preferred embodiment of the present invention.

The present invention preferably relates to a writing instrument that includes a display module for displaying a digitized textual or graphic presentation. The display module is customized to show a presentation according to the presentation's intended purpose (i.e., commercial, informative, advertising, etc.). The presentation may be an advertisement, information about a particular subject, an insignia or logo, or any other digital graphic image or digital text image. The presentation may include information about a place, event, person, entity or other concept for which the presentation is intended to capture and stimulate a user or consumer's attention. The presentation can be displayed on the display module in many different forms, depending on the needs and or intentions of the user or consumer. For example, the presentation could be displayed as a "moving marquee" so that it can be seen by a user or consumer as it "scrolls" across the display module. Alternatively, the presentation could be flashed on the display module at periodic intervals or faded in and out of view on the display module at the desired fade rate. The present invention contemplates and facilitates a presentation in a movie-like format as technology becomes more affordable and such implementation becomes economically feasible. In one preferred embodiment, the display module is activated by a motion detector built into the writing instrument and coupled to the display module. In another embodiment, the display module is activated or deactivated by the motion of propelling or repelling the ink cartridge into or out of the writing position. In either embodiment, once activated, the display module would then be powered on for a predetermined period of time, corresponding to the length of the presentation plus an additional amount of display time, before turning off. Thus, the built-in power supply to the display module would last longer than if the display module were always activated. Moreover, because the display module is only activated when the writing instrument is moved or when the ink cartridge is propelled/repelled, the presentation is not displayed when a user is not viewing or using the writing instrument. Another alternative embodiment of the present invention involves the implementation of a connectivity port, such as a Universal Serial Bus (USB) port or IEEE 1394 compliant port, for uploading information regarding a presentation to an external device or downloading information regarding a presentation from an external device. The apparatus also includes a power source to power the display module and an electronic storage unit for storing a presentation. It should be appreciated that other embodiments relating to the activation of the display module are well within the spirit of the invention and are indeed contemplated herein. One additional exemplary embodiment within the spirit of the invention is the use of a cap to effect activation of the writing instrument by way of putting the cap on the writing instrument and/or removing the same. Another desirable embodiment contemplated for use in a writing instrument, calendar or any other of the many apparatuses within the scope of this invention, is to implement a display module that is activated upon gathering sufficient ambient light to power the display. Such a method of activation may be useful in the context of a wall calendar, wherein the calendar would not be moved for activation (such as with a writing instrument) but would rather be activated after the ambient light in the room in which it is hanging is sufficient to activate the display module built into the calendar.

Referring to FIG. 1, a preferred embodiment of a writing instrument apparatus 10, including a display module implemented in the form of an LCD 30, is illustrated. The writing instrument apparatus 10 is constructed to include a housing 11 in which an LCD cutout 20 is provided for insertion of the LCD 30. It should be appreciated that the description of the present invention and its implementation of an LCD is meant only to be illustrative of the use of any other type of panel electronic display. An LCD is described as it is the most ubiquitous and well-known commercially available panel display. However, as technology advances and other types of panel displays become economically viable, the present invention contemplates inclusion of such displays rather than an LCD.

Figure 1B:
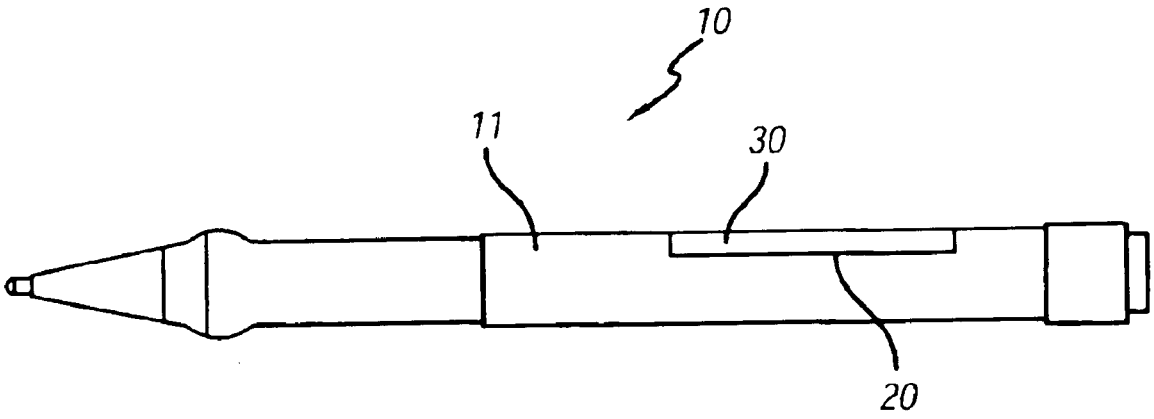

The housing 11 of the pen 10 is constructed in conventional manner such as the assembly of custom molded parts or stamped metal parts to accept an ink cartridge or other writing system. An LCD cutout 20 is provided within the housing 11 in order to facilitate the insertion of the LCD 30 for displaying a presentation. Once the LCD is inserted, a clear plastic window is laid over the display module and the cutout 20 in order to protect and contain the display module (FIG. 1B).

The LCD 30 is a conventional LCD. An LCD is used rather than other display technologies because it is thinner and lighter than a standard cathode ray tube (CRT) display. Additionally, the LCD 30 of the present invention draws significantly less power than a conventional CRT display.

Generally, an LCD of the type included in the present invention is constructed by beginning with two pieces of polarized glass. A polymer that creates microscopic grooves in the surface is rubbed on the side of the glass that does not have the polarizing film. It should be appreciated that in order for the LCD to function properly, the grooves must be in the same direction as the polarizing film. The grooves and polarizing film form a filter-like structure. A coating of nematic liquid crystals (TN) is then added to one of the filters. The grooves will cause the first layer of molecules of the nematic liquid crystals to align with the filter's orientation. A second piece of glass, on which the polarizing film is added at a right angle to the first, is then added to the structure. Each successive layer of TN molecules will gradually twist until the uppermost layer is at a 90-degree angle to the bottom, matching the polarized glass filters. As light strikes the first layer/filter, it is polarized. The molecules in each layer then guide the light they receive to the next layer. As the light passes through the liquid crystal layers, the molecules also change the light's plane of vibration to match their own angle. When the light reaches the far side of the liquid crystal substance, it vibrates at the same angle as the final layer of molecules. If the final layer is matched up with the second polarized glass filter, then the light will pass through, effectively indicating a "blank" area on the LCD.

Thus, in a functioning LCD, when an electric charge (current) is applied to the liquid crystal molecules, the molecules untwist. When the molecules straighten out, they change the angle of the light passing through them so that it no longer matches the angle of the top polarizing filter. Consequently, no light can pass through that area of the LCD, which makes that area darker than the surrounding areas, effectively causing an "image" to be displayed.

Figure 2:
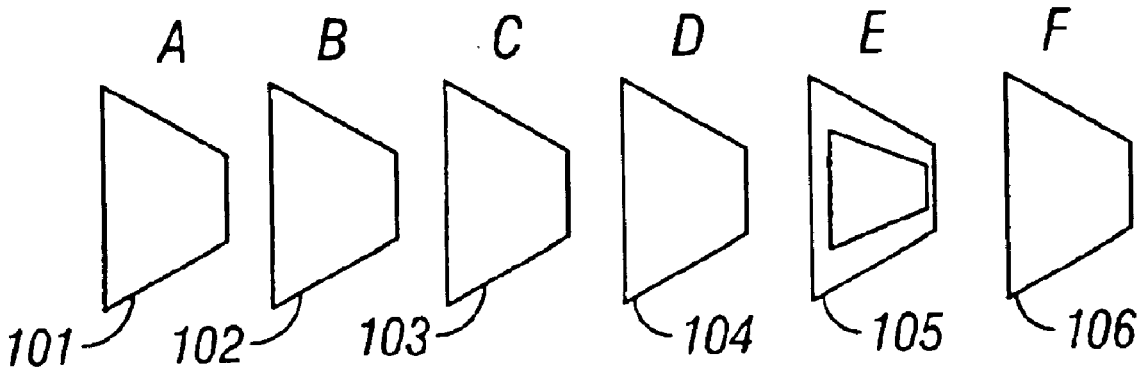
FIG. 2 is a schematic of the construction of a simplified LCD illustrating the basic principles of the type of LCD that may be used in the present invention.

Referring to FIG. 2, the layered construction of a simple LCD is illustrated. The schematic of FIG. 2 is meant to provide only a basic overview and illustrative example of the principles governing how a typical LCD functions. Many panel display constructions are known in the art and all are equally adaptable for use in the present invention. One example is the use of an LCD. In an LCD, the first layer is a mirror 101, which makes the LCD reflective. Next, a piece of glass 102 with a polarizing film P on the bottom side is added. The top side of the piece of glass 102 is a common electrode plane 103, which is made of indium-tin oxide. The common electrode plane 103 covers the entire area of the LCD. The next layer above the common electrode plane 103 is a layer of liquid crystal substance 104. Next, another piece of glass 105 is added, with, for example, an electrode 106 in the shape of a rectangle on the bottom. The rectangular electrode 106 is the "image" to be displayed on the exemplary LCD described. Finally, on top of the glass 105 is another polarizing film P' at a right angle to the first one P.

The electrode 106 is coupled to a power source 201, such as a battery. When there is no current, light entering through the front of the LCD will simply hit the mirror 101 and bounce back out. However, when the power source 201 supplies current to the electrode 106, the liquid crystal molecules 104 between the common-plane electrode 103 and the electrode shaped like a rectangle 106 untwist and block the light in that region from passing through. That makes the LCD display the rectangle as a black area. That is, the rectangle is the presentation displayed on the LCD.

The foregoing description of an LCD is meant to be merely illustrative in describing, generally, how the simplest LCD functions. The principles of this simple LCD are applicable to the LCD 30 of the present invention. However, the LCD 30 of the present invention also utilizes many more features of common LCD's known generally in the art generally and any type of LCD can be used in the present invention. Moreover, other types of displays, such as those in development that employ electronic ink, or other types of thin display technology, can be used in the present invention with equal functionality and effectiveness.

Figure 3A:
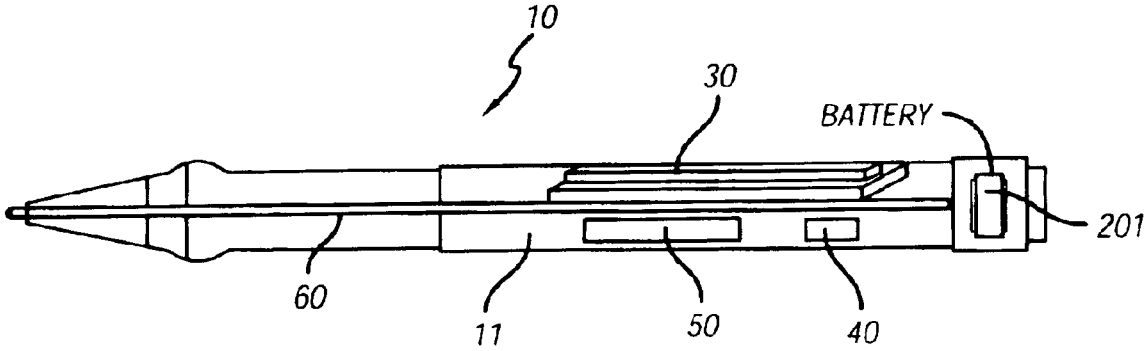
FIGS. 3A & 3B are schematics showing two different embodiments of the electrical components of the present invention.
Figure 3B:
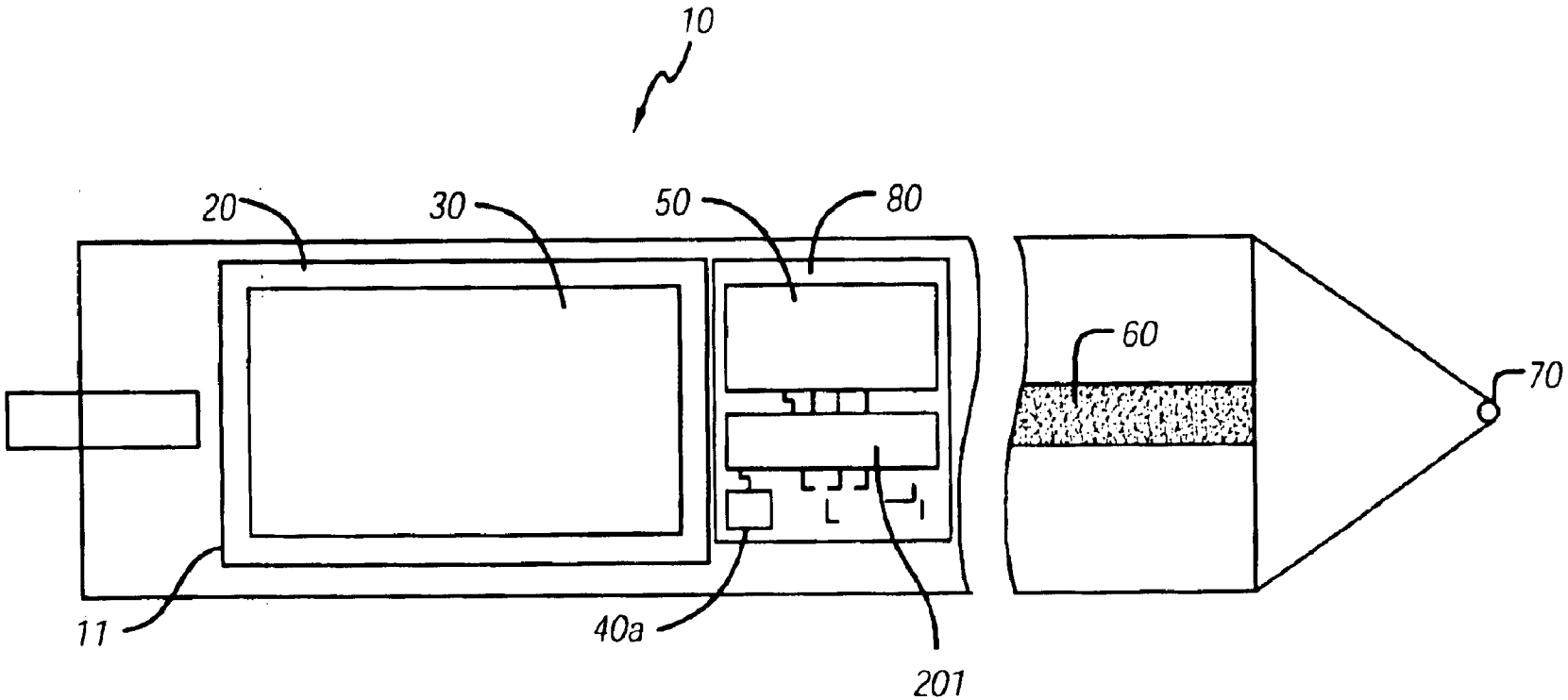

Referring to FIGS. 3A and 3B, which provide abstracted illustrations in accordance with the present invention, the housing 11 is provided with an electrically operated storage unit 50, such as a computer chip, which stores a presentation to be displayed by the LCD 30. The LCD 30 is installed within the housing 11 at the LCD insert 20. The configuration according to the present invention makes it possible that a presentation is produced on the LCD 30 in order to provide an advertisement, information or image as desired to communicate to the user or consumer of the writing instrument. Preferably, the apparatus includes an actuation switch 40, wherein movement of the apparatus causes the triggering of the actuation switch. The actuation switch 40 is coupled to the power source 201. Consequently, when the apparatus is moved, the actuation switch 40 is triggered and the power source is signaled to provide current to the storage unit 50 and the LCD 30. Thus, when the apparatus is moved (or otherwise activated), the preprogrammed presentation stored in the storage unit 50 is displayed on the LCD 30. Another embodiment for automatic activation of the presentation is shown with reference to FIG. 3B. The apparatus is illustrated implementing a different type of actuation switch 40*a*. This actuation switch is included in the apparatus in accordance with functionality that allows for activation or deactivation of the LCD according to the triggering of actuation switch 40*a* by the motion of propelling or repelling ink cartridge 60 into or out of writing position for the apparatus. It should be appreciated that the LCD 30, actuation switch 40, power source 201 and storage unit 50 are merely illustrative of the preferred embodiment and are not meant to be exclusive of other configurations of electrical coupling to one another. It should be understood that changes in the overall configuration may be made without departing from the spirit and scope of the present invention.

As described above, the present invention contemplated many methods of activating a presentation for display. For example, a presentation may be activated for display by motion detection or by propelling/repelling action of the ink cartridge. With respect to motion activation of a presentation, many methods of such activation are possible. Exemplars of the two types of actuation switches 40 and 40*a* function as follows.

With respect to motion actuation switch 40, generally, a small conductive metallic ball (or any other type of electrically conductive material) is enclosed in a cavity containing two electrical contacts at its base. The contacts are separated and no complete circuit is formed by them. However, when the metallic ball is in contact with the two electrical contacts, the circuit is completed as current is passed between the two electrical contacts by the metallic ball. Any significant motion of the writing instrument will cause the metallic ball to move within the enclosed cavity, causing the making (i.e., completing the circuit) and breaking of the electrical connection between the two contacts. The display circuitry (e.g., storage unit 50, LCD 30, power source 201) responds to this change a change in this electrical connection in which the circuit is completed and broken by activating the LCD 30 for a predetermined period of time. Thus, the present invention implements the novel concept of displaying a presentation, such as an advertisement, to a user upon the user picking up and simply moving the pen in any direction.

With respect to ink cartridge propelling/repelling actuation switch 40*a*, writing instruments rely on a commonly known spring-like mechanism to propel and repel the ink cartridge. The present invention implements the novel concept of including a conductive metal piece that slides between two electrical contacts on the mechanism within the writing instrument that propels and repels the ink cartridge. When the ink cartridge is propelled, the metal piece makes the electrical connection between the two contacts. When the ink cartridge is repelled, the metal piece breaks the electrical connection between the two contacts. The display circuitry responds to a change in this electrical connection, activating the LCD for a predetermined amount of time.

In accordance with an advantageous feature of the present invention, a power source 201 is provided to supply current to the storage unit 50 and the LCD 30; consequently a presentation can be displayed easily and simply. In accordance with a particular embodiment, a solar cell or other unit for producing current is included to supply current. This embodiment contemplates storing current in a chargeable battery or other power supply when the solar cell or other unit is exposed to light.

The storage unit 50, power source 201 and the LCD 30 are arranged in a chamber in the housing in order to safely accommodate the individual structural components. Additionally, such a chamber ensures that the use of the writing instrument apparatus 10 is not impaired by any of the electronic components of the present invention and vice versa. It should be particularly appreciated that the storage unit 50 and power source 201 (as well as the actuation switch 40) can be constructed in a single chip design in which all of the electrical components are embodied within a single semiconductor device. Alternatively, one or more of the electrical components may be distinct from the others. Such flexibility in design allows for many different implementations of the present invention and facilitates interchangeability of electrical components between different apparatuses as well as the reusability of the electrical components should a different presentation on the instant apparatus be desired.

Figure 4:
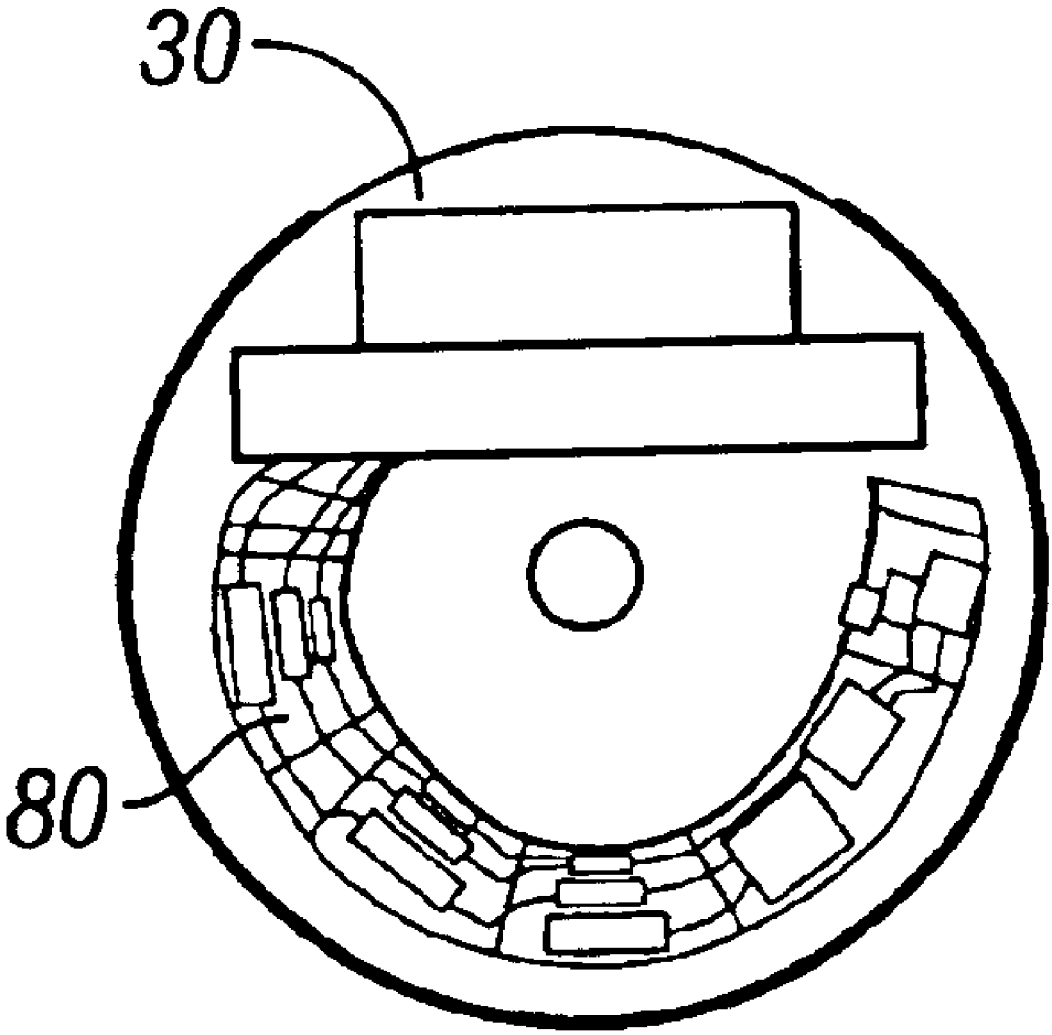
FIG. 4 is a cross section of the preferred embodiment.

FIG. 4 shows a longitudinal cross section of a preferred embodiment of the present invention in which it can be seen that the electrical components described above are coupled to a flexible printed circuit board (PCB) so as to facilitate more efficient design of the preferred embodiment. The use of a flexible PCB also allows for variations in design and implementation that are included within the spirit of the present invention.

Referring to the embodiments illustrated in both FIGS. 3A and 3B, an arrangement of individual components within the housing 11 is provided. The LCD 30 is coupled to PCB 80, which includes electronic storage unit 50, along with the actuating switch 40/40*a* and power source 201 for supplying current to the storage unit 50 and LCD 30. The PCB 80 is inserted into the chamber in the housing 11 of the writing instrument apparatus 10. The storage unit 50 is coupled to the power source 201. When the actuating switch 40 senses motion or other indicia of use (e.g., propelling/repelling of the ink cartridge using actuation switch 40*a*), such motion or use causes current to flow from the power source 201, activating the storage unit 50 and the LCD 30. The activation of the storage unit 50 allows the presentation stored therein to be displayed on the LCD 30. It should be appreciated that the storage unit 50 is intended to be a commercially available component that is capable of storing electronic signals in a digital form and reproducing those signals in a presentation form that is attractive to the user or consumer of the writing instrument when activated.

The presentation can be displayed on the LCD in many different forms, depending on the needs and or intentions of the user or consumer. For example, the presentation displayed on the LCD 30 can be in the design of a moving marquee of graphic or text that scrolls across the display. Alternatively, the presentation could be flashed on the LCD 30 at periodic intervals or faded in and out of view on the LCD 30 at the desired fade rate. Additionally, the LCD 30 can display a constant, stationary, text message or graphic image. Another embodiment includes the display of a presentation in a motion video ("movie") format. This would be accomplished by storing the motion video file in the storage unit 50 in a format compatible with display on an LCD. It should be appreciated that as display module, memory/storage and power supply technologies advance, the quality and length of all types of presentations will be greatly enhanced. It is contemplated that insofar as the present invention contemplates use of commercially available storage, power and LCD components, the uses and functionality of the present invention will expand according to the advancement in technology of its several components.

For example, a display implementing electronic ink technology could be used in place of the LCD contemplated herein. Electronic ink displays can be made thinner and more durable than many "thin" screens by using an electrically sensitive white chip that floats in a ball full of black dye. The chip rises or falls in the dye depending on an electrical charge. Many microcapsules are sandwiched between a piece of steel foil and a piece of clear plastic, and, unlike LCDs, they do not need to be backlit for an image to be visible. The absence of a lamp for backlighting, and the use of a steel foil, are what allow the screens to be significantly thinner than even a conventional LCD, which, as described above, typically uses a lamp and two sheets of glass. Additionally, as described above, one advantage of the present invention is that the use of an LCD allows for a significantly lower power draw than would be required for a conventional CRT display (assuming one could be fitted within the construction of the claimed invention). This advantage would be further accentuated by using an electronic ink or other low power display. For example, electronic ink displays would tend to consume less power than an LCD and, unlike LCDs, they don't require a continuous supply of power to render images; once the microcapsules are electrically charged, they can hold the image without more power (i.e., the display can maintain an image when the power is off).

A presentation is preferably pre-loaded into the storage unit upon manufacture or assembly of the apparatus 10. However, it should be appreciated that the storage unit 50 is comprised of commercially available nonvolatile memory, such as flash memory, and may be rewritable depending on the component installed in a particular apparatus 10. Therefore, the presentation on a single apparatus can be modified if desired. Modification of the presentation in the storage unit may be affected by downloading a new presentation to the storage unit for display on the LCD 30 by way of a USB port or other similar type of computer port (such as IEEE 1394). It should be appreciated that a USB bus connecting to a USB port may be an alternative power source in order to preserve the life of the installed power source 201. A typical USB bus distributes 0.5 amps (500 milliamps) of power through each port. Thus, low power devices, such as the apparatus 10 of the present invention, that normally require a separate power source, such as power source 201, can be powered through the USB cable (bus).

The present invention not only contemplates structural adaptability while implementing the novel advertising concepts described herein, functional adaptability is also easily implemented and built upon the novel concepts of the present invention. An example of such functional adaptability is expanding the operability of the actuation switch to include an interactive aspect, such as a "quiz game" concept. In this sense, the actuating switch (e.g., motion activation, ink cartridge propel/repel activation, etc.) could be used to interact with the display of data. A series of stored questions is presented to the user. Each question is presented for a set period of time during which time players try to guess the answer. Activating the writing instrument (for example, via actuation switch 40 or 40*a*) before the predetermined period of time expires will cause correct answer to be displayed. Causing activation of the writing instrument again causes the next question to be presented. If time expires after a question is presented, the answer is still displayed but it would indicate (e.g., by blinking) that the time to answer had expired. Such a quiz game could be user customizable by, for example, programming the device via the world wide web during design of a writing instrument and presentation. A simulation program running on a host website would allow a user to view their quiz game presentation before ordering it and causing the manufacturer to produce the writing instrument with the desired presentation. Obviously, such a self-programming presentation via the world wide web is available for all types of presentations contemplated herein, not solely the quiz game type of presentation.

The embodiments illustrated in the drawings and described herein are only exemplary realizations of the present invention. The invention is not limited to these embodiments; rather, various modifications are possible and, indeed, contemplated by the present invention. For example, the storage and reproducing unit according to the present invention can also be mounted in other types of presentation apparatuses so that a large variety of apparatuses, such as key chains, mugs, calendars, lighters and other similar types of apparatuses used in the advertising specialty and souvenir marketplaces, all providing many different types of presentations, can be produced and are contemplated to be within the scope of the present invention.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than by the foregoing description, and all changes that come within the meaning and range of equivalency of the claims are therefore intended to be embraced therein.

What is claimed is:

1. A writing instrument comprising:

a housing;

an LCD display module joined to the housing;

an electrically operated storage device;

a computer port for accepting an external connection, wherein an external device is coupled to the computer port for downloading a selectively customized presentation from the external device to the writing instrument;

a power supply; and an actuation switch, wherein the LCD display module displays the selectively customized presentation that is programmed and stored in the electrically operated storage device, and the presentation is displayed in response to triggering of the actuation switch.

2. The writing instrument of claim 1 wherein the semiconductor chip is connected to a flexible printed circuit board.

3. The writing instrument of claim 1, wherein the power supply is comprised of a solar cell.

4. The writing instrument of claim 3, wherein the housing comprises a chamber, and wherein the storage device, display module and solar cell are arranged in the chamber.

5. The writing instrument of claim 1, wherein the presentation is provided in the form of an image automatically scrolling across the LCD display module, the scrolling image being viewable by a user when the writing instrument is stationary.

6. The writing instrument of claim 1, wherein the presentation is provided in the form of a flashing image.

7. The writing instrument of claim 1, wherein the presentation is provided in the form of a non-moving image that fades in and out of view.

8. The writing instrument of claim 1, wherein the housing comprises a chamber, and wherein the storage device and display module are arranged in the chamber.

9. The writing instrument of claim 1, wherein the housing comprises a chamber, and wherein the storage device, display module and power supply are arranged in the chamber.

10. The writing instrument of claim 1, wherein the actuation switch is triggered by movement.

11. The writing instrument of claim 1, wherein the actuation switch is triggered by propelling or repelling an ink cartridge within the writing instrument.

12. The writing instrument of claim 1, wherein the external source is a computer.

13. The writing instrument according to claim 1, wherein the writing instrument is a pen.

14. The writing instrument according to claim 1, wherein the computer port is a Universal Serial Bus ("USB") port.

15. The writing instrument according to claim 1, wherein the computer port is an IEEE 1394 compliant port.

16. The writing instrument according to claim 1, wherein the presentation is in a motion video format.

17. The writing instrument according to claim 1, wherein the storage device is a rewritable nonvolatile memory.

18. A method for displaying a presentation on a writing instrument comprising:

providing a power source;

providing a storage unit coupled to the power source;

providing a computer port for accepting an external connection;

providing an external device coupled to the computer port;

downloading a selectively customized presentation from the external device to the writing instrument;

storing the presentation in the storage unit;

providing an electronic ink display module coupled to the power source and coupled to the storage unit;

providing an actuation member, wherein the actuation member signals the power source to send current to the storage unit and the electronic ink display module when the actuation member is triggered; and displaying the presentation on the electronic ink display module in response to current supplied to the storage unit by the power source in response to signaling by the actuation member.

19. The writing instrument according to claim 18, wherein the writing instrument is a pen.

20. The method according to claim 18, wherein the computer port is a Universal Serial Bus ("USB") port.

21. The method according to claim 18, wherein the computer port is an IEEE 1394 compliant port.

22. The method according to claim 18, wherein the electronic ink display module is housed within a pen.

23. The method of claim 18, wherein the presentation is in a motion video format.

24. The method according to claim 18, wherein the storage device is a rewritable nonvolatile memory.

* * * * *